United States Patent [19]

Bell et al.

[11] Patent Number: 4,759,247

[45] Date of Patent: Jul. 26, 1988

[54] ROTARY DIES WITH ADJUSTABLE CUTTER FORCE

[75] Inventors: Jerry L. Bell, Rochester Hills, Mich.; William C. Bollinger, Bradenton, Fla.

[73] Assignee: Bernal Rotary Systems, Inc., Troy, Mich.

[21] Appl. No.: 112,228

[22] Filed: Oct. 22, 1987

[51] Int. Cl.[4] ..... B26D 1/62

[52] U.S. Cl. ..... 83/346; 83/344; 83/506; 83/700

[58] Field of Search ..... 83/344, 346, 506, 700

[56] References Cited

U.S. PATENT DOCUMENTS

| | | | |
|---|---|---|---|
| 3,570,348 | 3/1971 | Hallden | 83/344 X |
| 4,450,740 | 5/1984 | Chapman, Jr. et al. | 83/344 X |
| 4,553,461 | 11/1985 | Belongia | 83/344 |

*Primary Examiner*—Frank T. Yost

*Attorney, Agent, or Firm*—Barnes, Kisselle, Raisch, Choate, Whittemore & Hulbert

[57] ABSTRACT

Coacting die cylinders with one cylinder having a cutting blade and the other cylinder an anvil surface which when rotating cooperate to cut a blank from a web of low density material. The blade and the anvil surface are tapered in opposite axial directions so that the clearance between them can be readily varied and adjusted by moving the cylinders axially relative to each other. Preferably, the cylinders each have a pair of cylindrical bearers which are in contact and rolling engagement with each other when the cylinders are operating to cut a web of material. The die cylinders are journaled in bearing assemblies carried by the cylinders and removably received in the stand to facilitate easy removal and installation of the die cylinders when desired.

9 Claims, 3 Drawing Sheets

FIG.4
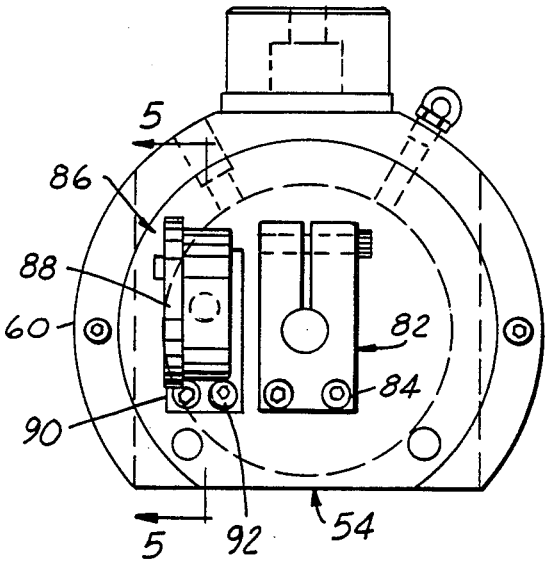
FIG.5
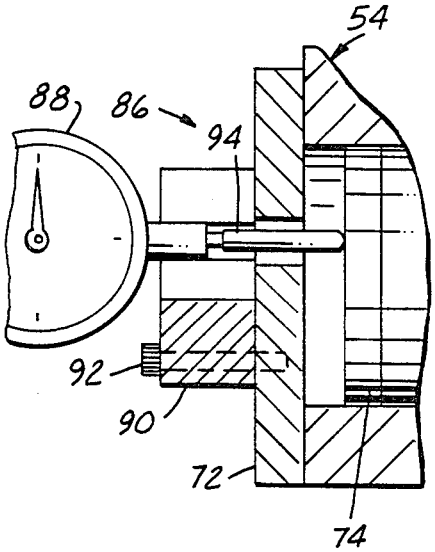
FIG.6
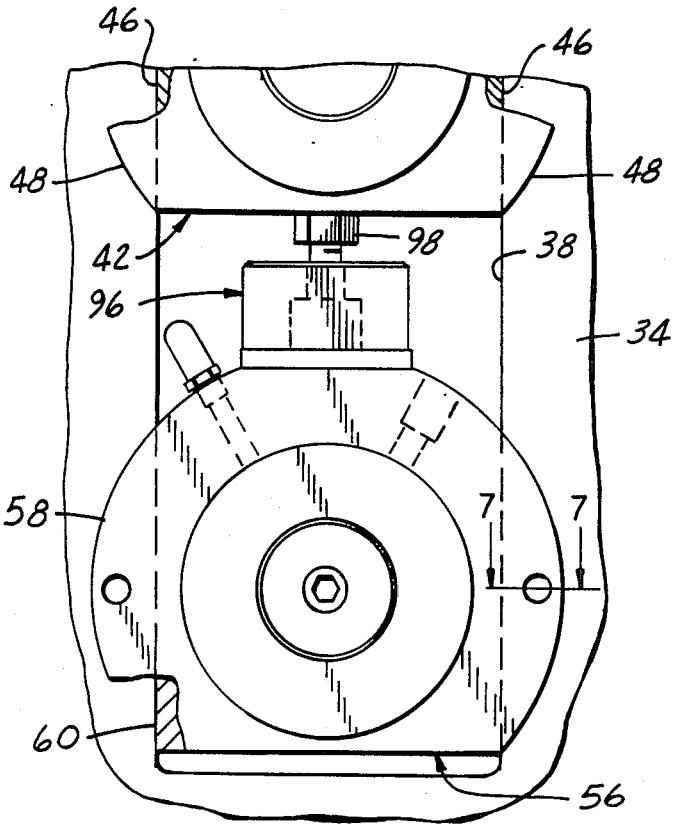
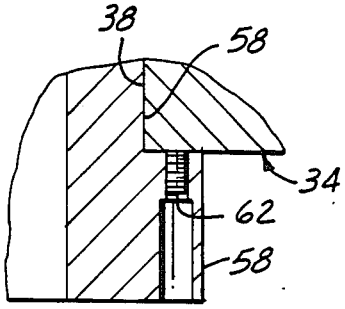
FIG.7

ROTARY DIES WITH ADJUSTABLE CUTTER FORCE

FIELD

This invention relates to rotary die cutting of blanks from thin sheets of low density materials of non-woven fibers, plastic film and the like. More particularly, this invention relates to rotary cutting dies with a readily adjustable cutting force.

BACKGROUND

One previously known way of rotary cutting is to pass a web of material between a pair of superimposed and rotating metal cylinders with one cylinder having a plain cylindrical surface acting as an anvil for cutting elements carried by the other cylinder. The cutting elements project generally radially outwardly from the body of the other cylinder and have a sharp knife edge with a generally V-shaped cross-section. The cutting elements can be either separate inserts received in the cylinder or a homogenously integral part of the cylinder. A method and apparatus for producing the V-shaped cutting elements as an integral part of a metal cylinder is disclosed in U.S. Pat. Nos. 3,550,479 and 3,796,851.

These rotary dies will satisfactorily cut paper, paper board, metal foil and other materials having a relatively high density. With such relatively high density materials, once the sharp knife-edge cuts through about 50% to 60% of their thickness, they are compressed sufficiently to burst or separate with their cut edges having a relatively clean and smoothly cut appearance to the naked eye.

However, such rotary dies are impractical for cutting sheets of low density materials such as films and non-woven fibers which usually have a thickness of about 0.005 to 0.030 of an inch. Such non-woven fiber materials typically have an individual fiber thickness of less than about 0.0002 of an inch. Typical low density materials are polyester, polypropylene and polyethylene plastics. When cutting a low density material, the sharp knife-edge must pass through essentially the entire thickness of the material to sever it because it flows easily and does not have a tendency to burst, unlike a high density material. To produce an edge having a smooth and clean cut appearance to the naked eye, it is also necessary for the sharp knife-edge to pass essentially completely through the thickness of a low density material to avoid stringers and jagged edges.

In order to satisfactorily cut or sever a web of a low density material with rotary cutting dies on a mass production basis, it is necessary to orient and position the rotating die cylinders so that between the rotating cutting blade and the anvil there is either a slight minimum clearance, no clearance, or a slight compression or interference of about $\pm 0.0001$ of an inch. This is usually referred to as positive, zero or negative clearance.

SUMMARY

Pursuant to this invention, rotary cutting dies with readily adjustable clearance are provided by forming both the anvil cylinder and the cutting blades with complementary and opposed tapers so that the clearance between them can be varied and adjusted by shifting the die cylinders axially toward and away from each other.

Preferably, to facilitate alignment and shifting of the die cylinders and to eliminate the need to mount them for rotation in extremely accurate bearings, both die cylinders have a pair of complementary cylindrical bearers, which in operation are maintained in rolling contact with each other. Preferably, all the bearers have the same diameter. Preferably, the bearers associated with each die cylinder are concentric with both the axis of their associated cutting blades or anvil and the bearings journaling the cylinder for rotation.

To facilitate alignment, adjustment and changing of pairs of die cylinders, preferably they have bearing assemblies carried by the cylinders and removably received in a die stand.

Objects, features and advantages of this invention are to provide a pair of rotary die cylinders which easily, reliably and cleanly cut a web of low density material, provide improved appearance, smoothness and squareness of the cut edge, greatly improve die life, provide reliable and easy adjustment of the clearance between the cutting blade and anvil, can be produced in prehardened tool steel by electrical discharge machining, when in use do not require frequent adjustment to maintain the cutting edges in the desired clearance and cooperative relationship with the anvil, can be economically manufactured and assembled and are rugged, durable, reliable and require little service and maintenance.

BRIEF DESCRIPTION OF THE DRAWINGS

These and other objects, features and advantages of this invention will be apparent from the following detailed description, appended claims and accompanying drawings in which:

FIG. 4 is an enlarged end view of a bearing and adjustment assembly for the anvil rotary die cylinder;

FIG. 5 is a fragmentary sectional view taken generally on line 5—5 of FIG. 4 and illustrating a dial gage for indicating the axial displacement of the anvil rotary die cylinder;

FIG. 6 is a fragmentary and enlarged view of the bearing assembly and stand of FIG. 3;

FIG. 7 is a fragmentary sectional view taken generally on line 7—7 of FIG. 6.

DETAILED DESCRIPTION

Figure 1:
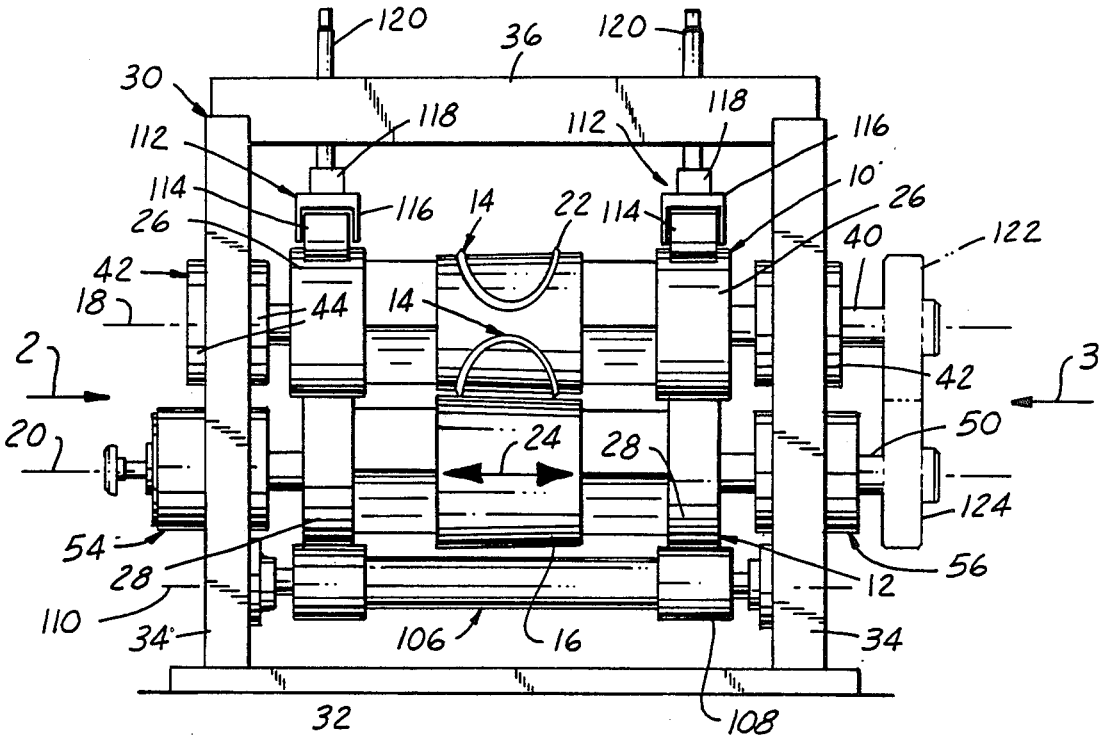
FIG. 1 is a side view of rotary die cylinders embodying this invention mounted in a die stand.
Figure 2:
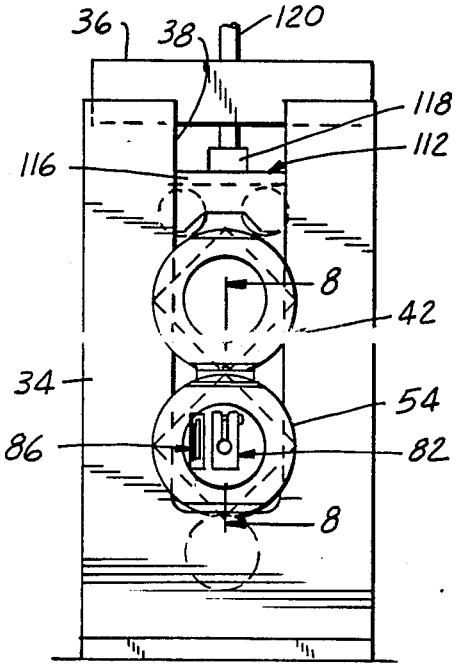
FIG. 2 is a left hand end view in the direction of arrow 2 of the cylinders and stand of FIG. 1.
Figure 3:
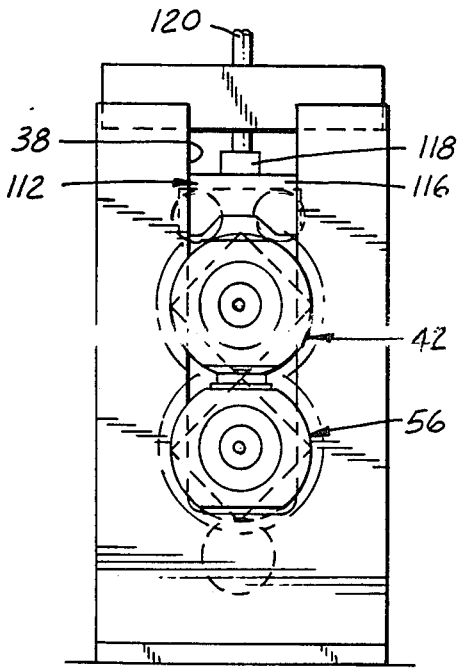
FIG. 3 is a right hand end view in the direction of arrow 3 of the cylinders and stand of FIG. 1.
Figure 8:
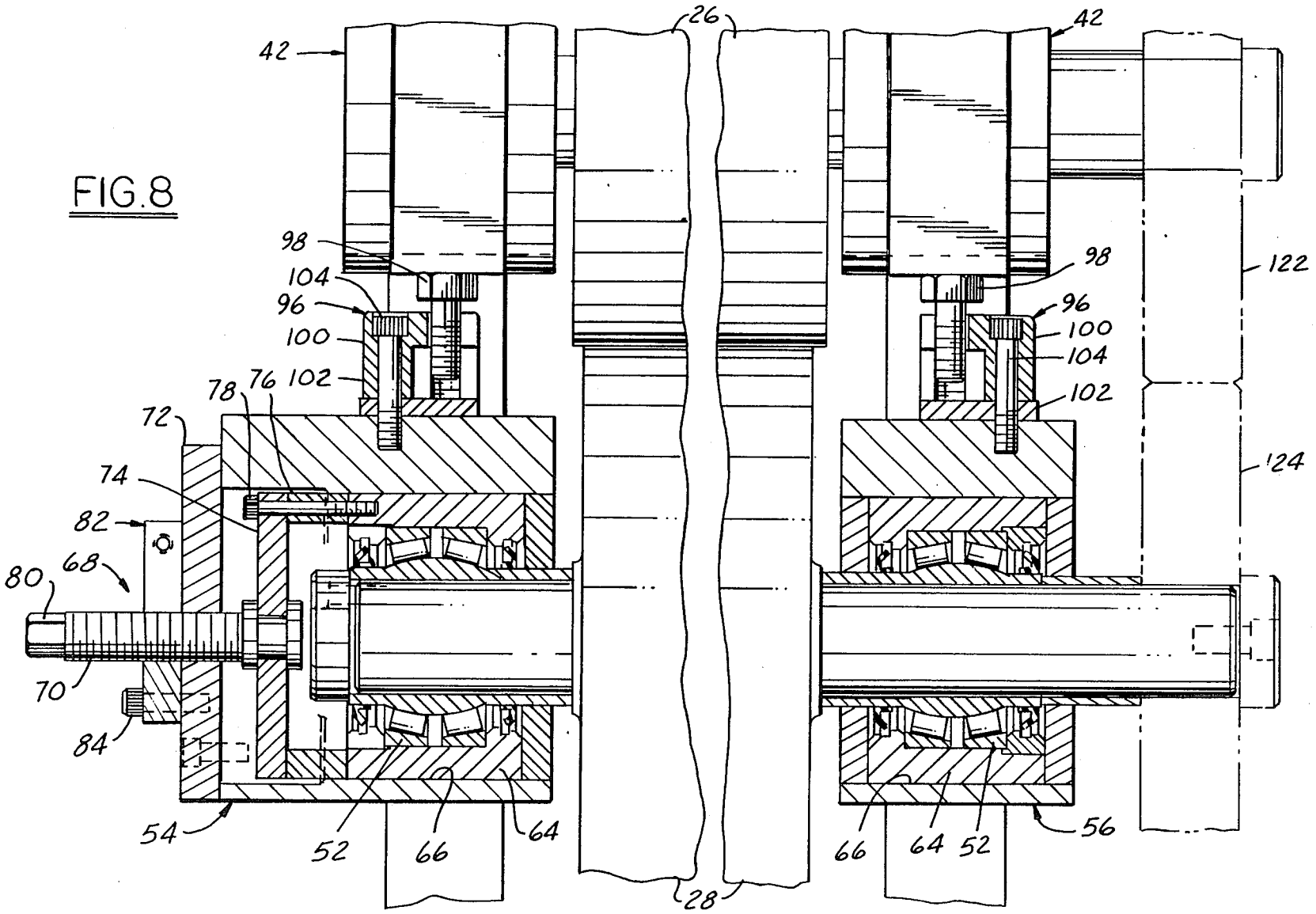
FIG. 8 is a fragmentary sectional view with portions broken away taken generally on line 8—8 of FIG. 2 and illustrating the relationship of the bearing assemblies and the rotary die cylinder in the stand.

Referring in more detail to the drawings, FIG. 1 is a side view illustrating a pair of rotary die cylinders 10 and 12 embodying this invention for cutting a generally circular blank from a web of a low-density material that passes between the rotating cylinders. The material is cut only by the coaction of a sharp knife-edge blade 14 with a V-shaped cross-section on the cylinder 10 with a smooth and continuous anvil surface 16 on the cylinder 12.

In accordance with this invention, to adjust the clearance between cutting blades 14 and anvil surface 16 they have complementarily and generally opposed tapers coincident with their associated axes of rotation 18 and 20 which are essentially parallel to each other. The anvil surface 16 is the frustum of a right circular cone with its axis coincident with the axis of rotation 20 of the anvil cylinder. Similarly, the tip or vertex 22 of each cutting blade 14 lies in a frustum of a right circular cone with its axis coincident with the axis of rotation 18 of the cutting die 10. These cone surfaces are tapered in opposite directions and have essentially the same rate of taper, which is usually about 0.005 to 0.030 and preferably about 0.010 to 0.020 of an inch per lineal or axial inch or 0.005 to 0.010 of an inch per side of the cone surface per lineal or axial inch.

With this conical or tapered construction and arrangement of the cutting blades and anvil, the clearance between them can be easily varied and adjusted by moving the cylinders along their axes relatively away from each other to increase the clearance and toward each other to decrease the clearance or even provide negative clearance. Preferably, to avoid adjusting the position of the cutting blades 14 relative to a web of material being fed between the cylinders, the clearance is adjusted by moving only the anvil cylinder 12 along its axis 20 as indicated in FIG. 1 by the arrows 24.

Preferably, to facilitate maintaining the axes of the die cylinders in parallel relationship and spaced apart a constant distance while permitting relative axial movement between them, the die cylinders each have a pair of spaced apart bearers 26 and 28 which engage each other while the cylinders are rotating. Each bearer has a plain and continuous right circular cylindrical surface with an axis coincident with the axis of rotation of its associated die cylinder. To provide in operation only rolling contact between each associated set of bearers 26, 28 and to essentially eliminate any sliding movement between them, all of the cylindrical surfaces of all of the bearers have essentially the same diameter. When making the die cylinders, the bearers also facilitate accurately making by grinding or otherwise the conical or tapered surfaces of the anvil and cutting blades.

To facilitate changing and replacing the die cylinders, they are removably mounted in a die stand 30 which has a base plate 32, a pair of uprights 34 each fixed at its lower end to the base plate, and a top plate 36 removably secured, such as by cap screws (not shown) to the other end of the uprights. The die cylinders are mounted by bearing housings slidably received in slots 38 through the uprights. A mounting shaft 40 of the cutting cylinder 10 is journaled for rotation by a pair bearings (not shown) each received in a housing 42 releasably entrapped in the die stand. Each housing 42 is generally spool-shaped with a pair of spaced spart flanges 44 slidably engaging the sides of an upright 34 and a central portion having a pair of flat faces 46 slidably received in the slot 38.

A mounting shaft 50 of the anvil cylinder 12 is jounaled for rotation by a pair of bearings 52 received in housings 54 and 56 releasably entrapped in the die stand. Each housing is generally spool-shaped with a pair of flanges 58 slidably engaging the sides of an upright 34 and a central portion having a pair of flat faces 60 slidably received in th slot 38. To eliminate end play, preferably both of the cylinders are journalled in tapered roller thrust bearings. As shown in FIG. 7, the inner flange of each housing can be urged into firm engagement with an associated upright by set screws 62.

To permit the anvil cylinder to be shifted axially, the bearings 52 are mounted in collars 64 slidably received in bores 66 through the housings 54 and 56. The anvil cylinder is shifted axially by manual drive mechanism 68 having a rotatable stud 70 threaded in a mounting plate 72 secured by cap screws 73 to the housing 54. One end of the stud is rotatably trapped by flanges in and end plate 74 secured with a spacer 76 to the collar 64 by cap screws 78. To facilitate rotating the stud, and hence axially shifting the anvil cylinder, a hex head 80 is provided on the free end of the stud. The stud is releasably locked in any desired position by a threaded and split clamp plate assembly 82 which is secured to the end plate 72 by a cap screw 84.

An indication of the extent of axially movement of the anvil cylinder is provided by a dial indicator assmebly 86, shown in FIGS. 4 and 5. A dial indicator 88 is secured in a mounting block 90 secured by a cap screw 92 to the mounting plate 72. The actuator probe or finger 94 of the dial indicator projects through a hole in the plate and is yieldably biased to bear on the end plate 74 secured to the axially movable collar 64.

The spacing between the bearing housings 42, 54 and 42, 56 of the cylinders and hence the alignment of their bearing assemblies can be varied and adjusted by a pair of adjustable stops 96 secured to the bearing housings 54 and 56 and each engaging one of the bearing housings 42. An adjustable stop screw 98 is threadably received in a housing 100 secured along with a shim block 102 to one of the bearing housings 54, 56 by a cap screw 104.

In assembly, the cylinders are supported on a roller 106 having a pair of cylindrical bearers 108 which are in rolling contact with bearers 20 of the anvil cylinder 12 and concentric with the axis of rotation 110 of the roller. The roller is journalled for rotation in precision bearing assemblies 112 mounted in the upright 34 of the stand. In operation, the bearers of the die cylinders are retained in rolling engagement with each other and the bearers of anvil cylinder 12 in engagement with the support roller 108, by a pair of adjustable roller assemblies 112. Each assembly 112 has a pair of spaced apart cylindrical rollers 114 journaled for rotation in a carrier bracket 116 which is connected by a swivel 118 to a threaded stud 120 received in a complimentary threaded hole through the top plate 36. By rotating the stud in opposite directions, the rollers 114 can be advanced into engagement with and retracted from the bearers 26 of the blade cylinder. This construction and arrangement for supporting the die cylinders along with the floating mounting of the bearing assemblies 42, 42, 54 and 56 of the die cylinders eliminates the need for extremely high precision bearings for journaling the die cylinders.

The die cylinders are couplied together for being driven to rotate in unison by a pair of meshed gears 122 and 124 keyed to the shafts 40 and 50 of the cylinders.

In use, blanks are cut from a web of low density material fed between the cylinders by the cooperation of the blades 14 with the anvil 24. The clearance between the blades and anvil is varied and adjusted as desired by manually turning the stud 70 of the adjuster mechanism 68 to shift the anvil 16 axially with respect to the cutting blade 22. By cooperation of the opposed tapers on the anvil and the cutting blade, the clearance between them is decreased as the cylinder 12 is shifted to the right (as viewed in FIG. 1), and increased as the cylinder 12 is shifted to the left (as viewed in the FIG. 1) The extent of the movement of the cylinder 12 is shown by the dial indicator 86. When the cylinder has been moved to the desired position, it can be locked therein by securing the clamp assembly 82.

With this invention, the clearance can be readily and easily adjusted, even while the die cylinders are operating. This greatly facilitates determining the correct clearance for proper cutting by making the adjustment under actual operating conditions. Once properly adjusted, the clearance is accurately maintained so that normally it does not have to be readjusted until the cutting edges begin to wear or there is some other change in operating conditions or the web of material being cut.

We claim:

1. Cylindrical dies which when rotating cut along a predetermined line of severance in a web of material which comprises: a pair of coacting die cylinders of metal constructed and arranged to be journaled for rotation, one of said cylinders having an anvil surface thereon which is essentially a frustum of a right circular cone with its axis essentially coincident with the axis of rotation of said one cylinder, at least one cutting blade on said other cylinder and having a sharp edge with its apex essentially throughout its length lying in a blade surface which is essentially a frustum of a right circular cone with its axis coincident with the axis of rotation of said other cylinder, said blade surface and said anvil surface tapering in axially opposite directions and both having essentially the same rate of taper, whereby when the coacting cylinders are in assembly with their axes of rotation essentially parallel and spaced apart a constant distance the clearance between the apex of the cutting blade and the anvil surface can be varied and adjusted by relatively moving the die cylinders axially to vary the minimum clearance between the cutting blade and the anvil surface.

2. The cylindrical dies of claim 1 wherein the taper of each of the blade surface and the anvil surface is in the range of about 0.005 to 0.030 of an inch per lineal inch.

3. The cylindrical dies of claim 1 which also comprise actuator means operably connected with said one of said cylinders and constructed and arranged to shift said one cylinder generally axially with respect to the other of said cylinders to thereby vary the minimum clearance between the cutting blade and the anvil surface.

4. The cylindrical dies of claim 1 which also comprise a first pair of axially spaced apart bearers on said one cylinder with said anvil surface disposed between them and with each of said bearers having a right circular cylindrical surface with its axis coincident with the axis of rotation of said one cylinder, a second pair of axially spaced apart bearers on said other cylinder with said severing blade disposed between them and each having a right circular cylindrical surface with its axis essentially coincident with the axis of rotation of said other cylinder, each of said bearers having essentially the same diameter, and the bearers being constructed, arranged and dimensioned such that each bearer when the cylinders are in operation of the first pair is in continuous contact and rolling engagement with an associated bearer of the second pair.

5. The cylindrical dies of claim 4 which also comprise actuator means operably connected said one cylinder and constructed and arranged to move said one cylinder generally axially with respect to said other cylinder to vary the minimum clearance between the cutting blade and the anvil surface.

6. The cylindrical dies of claim 4 which also comprise a stand, a support roller carried by said stand, journaled for rotation and constructed and arranged to contact and be in rolling engagement with the pair of bearers of one of said die cylinders when they are in operation, and adjustable roller means carried by said stand and constructed and arranged to contact and be in rolling engagement with the pair of bearers of the other of said die cylinders and to urge both pair of bearers into contact and rolling engagement with each other and such pair of bearers of such one die cylinder into contact and rolling engagement with said support roller, at least during operation of the die cylinders.

7. The cylindrical dies of claim 6 which also comprise actuator means operably connected with said one cylinder and constructed and arranged to move said one cylinder generally axially with respect to said other cylinder to vary the minimum clearance between the cutting blade and the anvil surface.

8. The cylindrical dies of claim 6 which also comprise uprights carried by said stand, a pair of spaced apart bearing mounting means carried by said uprights, a first pair of bearing assemblies carried by and journaling said one cylinder for rotation and removably and slidably received by said bearing mounting means, a second pair of bearing assemblies carried by and journalling said other die cylinder for rotation and removably and slidably received by said bearing mounting means whereby said cylinders can be readily journalled for rotation in said stand and removed and replaced when desired.

9. The cylindrical dies of claim 8 which also comprise a pair of adjustable stops carried by one pair of bearing assemblies and constructed and arranged in assembly to bear on the other pair of bearing assemblies for varying and adjusting the spacing between the bearing assemblies.

* * * * *